US011149724B2

(12) United States Patent
Raupach et al.

(10) Patent No.: US 11,149,724 B2
(45) Date of Patent: Oct. 19, 2021

(54) PERISTALTIC PUMP WITH REPLACEABLE DISPLACEMENT ELEMENT

(71) Applicant: ProMinent GmbH, Heidelberg (DE)

(72) Inventors: Phillipp Raupach, Dusseldorf (DE); Jonas Kohler, Aachen (DE)

(73) Assignee: ProMinent GmbH, Heidelberg (DE)

( * ) Notice: Subject to any disclaimer, the term of this patent is extended or adjusted under 35 U.S.C. 154(b) by 9 days.

(21) Appl. No.: 16/429,249

(22) Filed: Jun. 3, 2019

(65) Prior Publication Data

US 2019/0376505 A1 Dec. 12, 2019

(30) Foreign Application Priority Data

Jun. 7, 2018 (DE) ..... 10 2018 113 616.1

(51) Int. Cl.
*F04B 43/12* (2006.01)

(52) U.S. Cl.
CPC ..... *F04B 43/1253* (2013.01); *F04B 43/1276* (2013.01)

(58) Field of Classification Search
CPC ... F04B 43/1253; F04B 43/1276; F04B 45/08
USPC ..... 417/477.3, 477.8
See application file for complete search history.

(56) References Cited

U.S. PATENT DOCUMENTS

| | | | | |
|---|---|---|---|---|
| 3,192,863 | A * | 7/1965 | Vadot | F04B 43/1276 417/477.7 |
| 3,963,023 | A * | 6/1976 | Hankinson | F04B 43/1253 604/19 |
| 6,743,204 | B2 * | 6/2004 | Christenson | A61M 5/14232 417/477.7 |
| 8,469,682 | B2 * | 6/2013 | Ramirez, Jr. | F04B 43/1261 417/477.1 |
| 9,175,678 | B2 * | 11/2015 | Ono | F04B 43/1284 |
| 10,359,037 | B2 | 7/2019 | Yaeguchi et al. | |
| 2007/0031272 | A1 | 2/2007 | Ramirez | |

FOREIGN PATENT DOCUMENTS

| | | |
|---|---|---|
| DE | 8524202.0 U1 | 11/1985 |
| GB | 2385096 A | 8/2003 |
| WO | 2016/159277 A1 | 10/2016 |

* cited by examiner

*Primary Examiner* — Bryan M Lettman
(74) *Attorney, Agent, or Firm* — Paul & Paul

(57) ABSTRACT

A peristaltic pump includes a casing having a bottom, cover and wall forming a pump chamber, a tube connecting a casing inlet to a casing outlet arranged within the pump chamber, and a displacement element having at least two displacement members. The tube is arranged between the casing wall and the displacement element in such a way that due to rotation of the rotor the displacement members roll on the tube so the tube is squashed together so that a medium to be conveyed which is in the tube is displaced in the direction of the casing outlet. The displacement element has a first part fixed to the rotor and a second part which can be reciprocated between an operative position and a change position.

14 Claims, 8 Drawing Sheets

PERISTALTIC PUMP WITH REPLACEABLE DISPLACEMENT ELEMENT

CROSS-REFERENCE TO RELATED APPLICATION

Figure 1A:
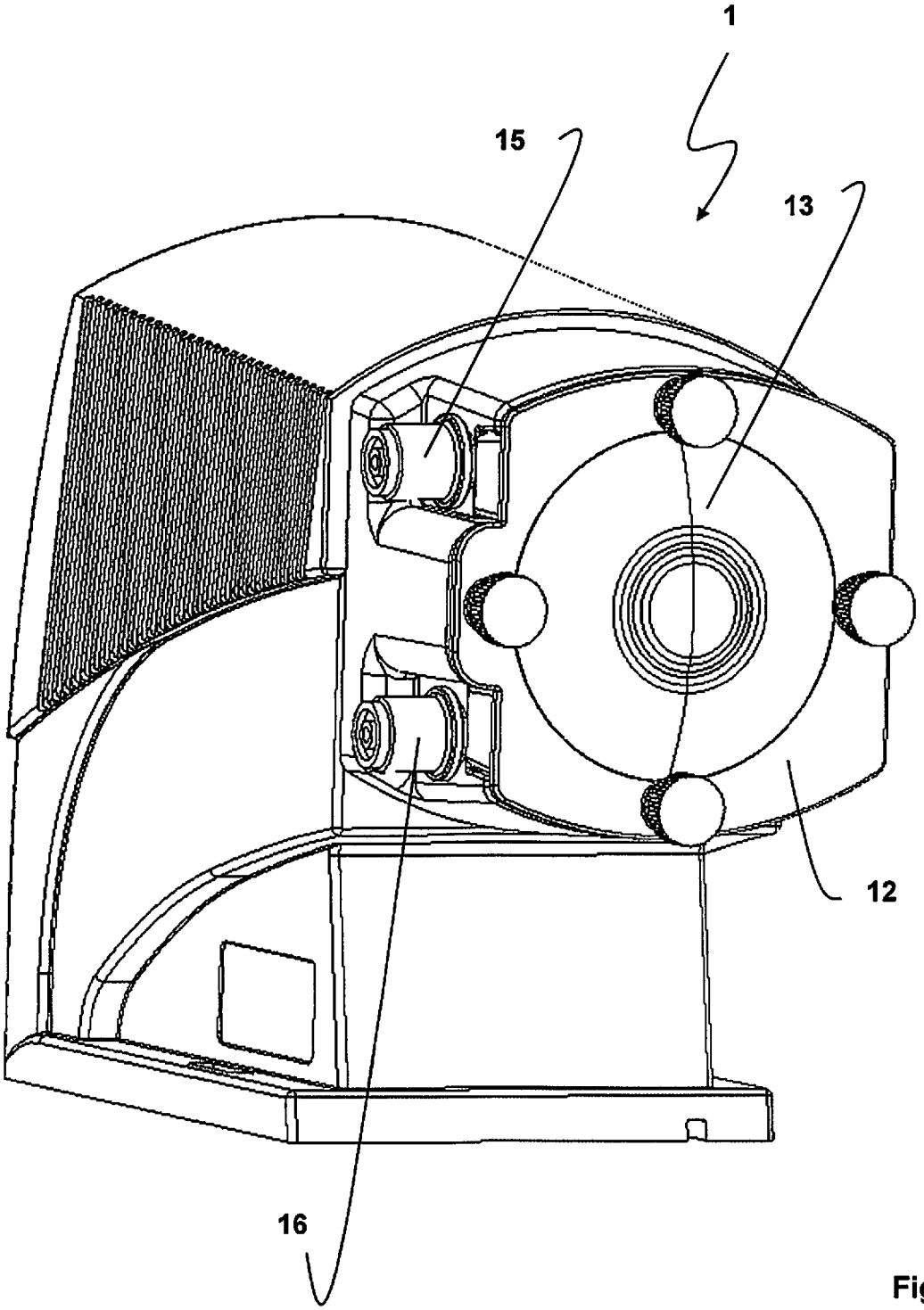

This application claims the priority of German Application No. 10 2018 113 616.1, filed on Jun. 7, 2018.

The present invention concerns a peristaltic pump. A peristaltic pump is a displacement pump in which the medium to be conveyed is conveyed by mechanical deformation of a tube within the tube. The peristaltic pump is therefore also referred to in the literature as a hose or roller pump.

The peristaltic pump has a casing comprising a casing bottom, a casing cover and a casing wall extending from the casing bottom to the casing cover. The casing forms a pump chamber and has a casing inlet and a casing outlet which respectively provide a communication with the pump chamber. Arranged in the pump chamber is a tube connecting the casing inlet to the casing outlet. In addition there is provided a displacement element which has at least two displacement members and is fixed to a rotor which is rotatable about a rotor axis. The consequence of this is that, in the rotary movement of the rotor, each displacement member performs a movement in an operative plane, wherein the tube is arranged between the casing wall and the displacement element in such a way that, by virtue of rotation of the rotor, the displacement members slide or roll on the tube so that the tube is mechanically deformed and a conveyed medium disposed in the tube is displaced in the direction of the casing outlet.

Such peristaltic pumps are known. They have the advantage that they are designed for continuous operation, they do not have any valves and they are nonetheless self-blocking. The self-blocking action is achieved in that, in any position of the rotor, the tube is clamped between one of the displacement members and the casing wall and is thus mechanically deformed.

As however the tube is mechanically deformed it has a relatively short service life and therefore has to be replaced at regular intervals.

The tube change operation is however very laborious and expensive by virtue of the self-blocking action as generally the entire pump has to be dismantled.

Therefore the object of the present invention is to be provide a peristaltic pump in which the tube change can be effected in a simple fashion.

That object is attained by a peristaltic pump of the kind set forth in the opening part of this specification in which the displacement element is of a two-part structure comprising a first part which is fixed to the rotor and a second part which has a displacement member, wherein the second part of the displacement element in at least one position of the rotor relative to the first part of the displacement element can be reciprocated between an operative position in which the operative planes of the two displacement members are identical and a change position in which the operative planes of the two displacement members are arranged parallel to each other.

In a preferred case the displacement member is a roller which rolls on the tube and mechanically compresses it in order to urge the medium to be conveyed which is in the tube in the desired direction.

By virtue of the measure according to the invention the second part of the displacement element which has a displacement member can now be displaced relative to the first part of the displacement element in a direction parallel to the rotor axis, at least in a position of the rotor in which the displacement member which is fixed to the second part of the displacement element is not in engagement with the tube.

When now the rotor is further rotated, for example through 180°, then the other displacement member comes out of engagement with the tube, that is to say the tube is no longer pressed by the displacement member. As however the displacement member on the second part of the displacement element is now in a different operative plane in which there is no tube, the tube is then no longer clamped between the displacement member and the casing wall and can be easily removed. In that case removal can be effected for example through the casing inlet or the casing outlet.

In principle therefore the tube can be changed without the entire peristaltic pump having to be dismantled. It is not even necessary to open the casing.

Frequently however the pump chamber is cleaned when changing the tube. In those cases it is advantageous if the second part of the displacement element is releasable from the first part of the displacement element, in at least one position of the rotor. That can be effected for example by it being still further moved in the direction of the rotor axis. In that situation it is additionally advantageous if the casing cover is at least partly removable or openable so that the second part of the displacement element can be removed for changing the tube and for cleaning the pump chamber.

In a further preferred configuration each part of the displacement element has at least one displacement member. In that respect, a support member can be provided in addition for tube guidance. Preferably a support member is arranged at each part of the displacement element so that, by rotation of the rotor, the support members can slide or roll on the tube, wherein the support members are arranged in such a way that they do not displace any medium to be conveyed which is disposed in the tube. In other words the support members are only there to hold the tube substantially in its position without mechanically deforming it. The support members can also be embodied by a suitable roller.

In a further preferred embodiment it is provided that the second part of the displacement element is also fixed to the rotor.

It has been found that in that way the durability of the peristaltic pump can be markedly improved as the forces necessary during the pumping operation can be transmitted directly by way of the rotor to both parts of the displacement element.

In a further preferred embodiment it is provided that the rotor is of a non-circular cross-section, wherein the first part of the displacement element and possibly also the second part of the displacement element have an opening, more specifically best a through opening, the internal contour of which is of a configuration corresponding to the external contour of the rotor so that, when the first and/or the second part of the displacement element is pushed with its opening over the rotor, a positively locking connection is produced between the rotor and the first or second part respectively of the displacement element.

It is therefore not absolutely necessary for the two parts of the displacement element to be additionally secured to the rotor, they are simply fitted with the opening on to the rotor so that, by virtue of the corresponding drive surfaces, that is to say the external contour of the rotor and the internal contour of the opening, the two parts of the displacement element directly follow a rotary movement of the rotor.

In a further preferred embodiment the first part and the second part of the displacement element are connected together by way of a groove-sliding block connection, the groove extending parallel to the rotor axis. By way of example the first part could have a groove while the second part has a projection in the form of a sliding block which is guided in the groove in the first part. In order to move the second part relative to the first part or even to release it from the first part it is then necessary to move the sliding block within the groove, that is to say parallel to the rotor axis.

In order to reinforce the connection between the first part and the second part of the displacement element the groove can be of an undercut configuration, wherein the sliding block is of a configuration corresponding to the groove. In that case the sliding block can only be moved along the groove parallel to the rotor axis. A movement perpendicular to the groove is not possible by virtue of the undercut configuration. An example of an undercut groove is a dovetail-section groove.

In a further preferred embodiment it is provided that the displacement element and the tube are arranged in the casing in such a way that, by rotation of the rotor, each displacement member can be moved into a position in which that displacement member is not in contact with the tube.

In addition it is advantageous if the tube is arranged substantially in a U-shape within the casing. The tube then passes around the displacement element over a peripheral angle of more than 180°, preferably more than 225°.

Figure 1B:
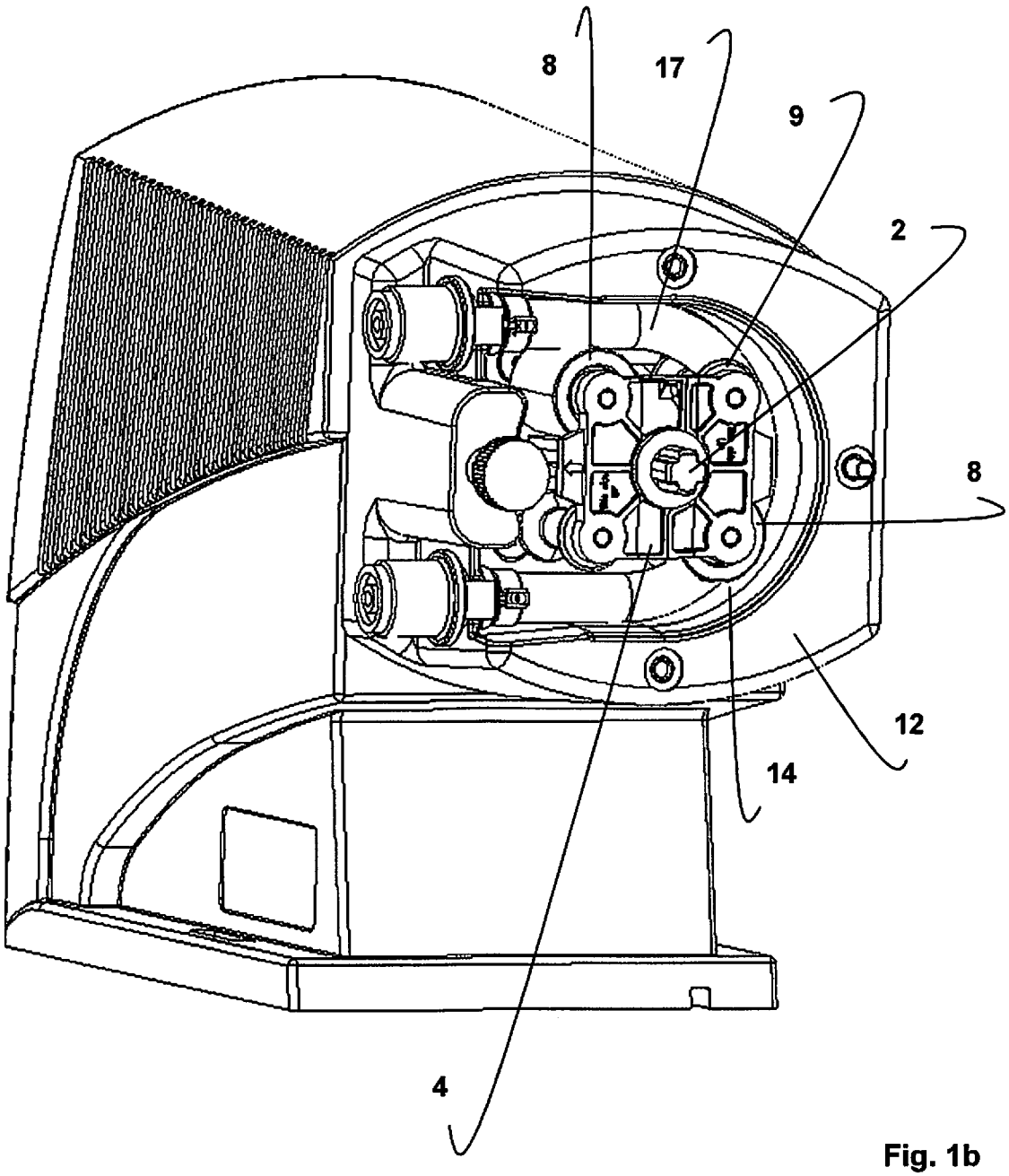
Figure 2:
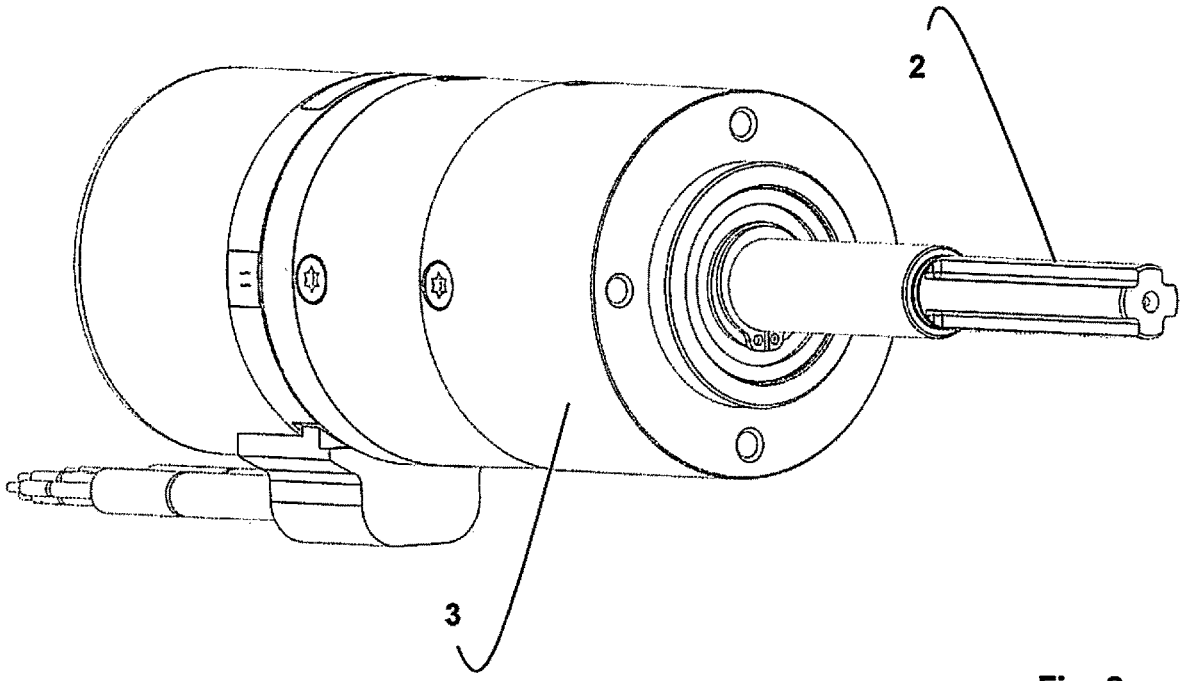
Figure 3:
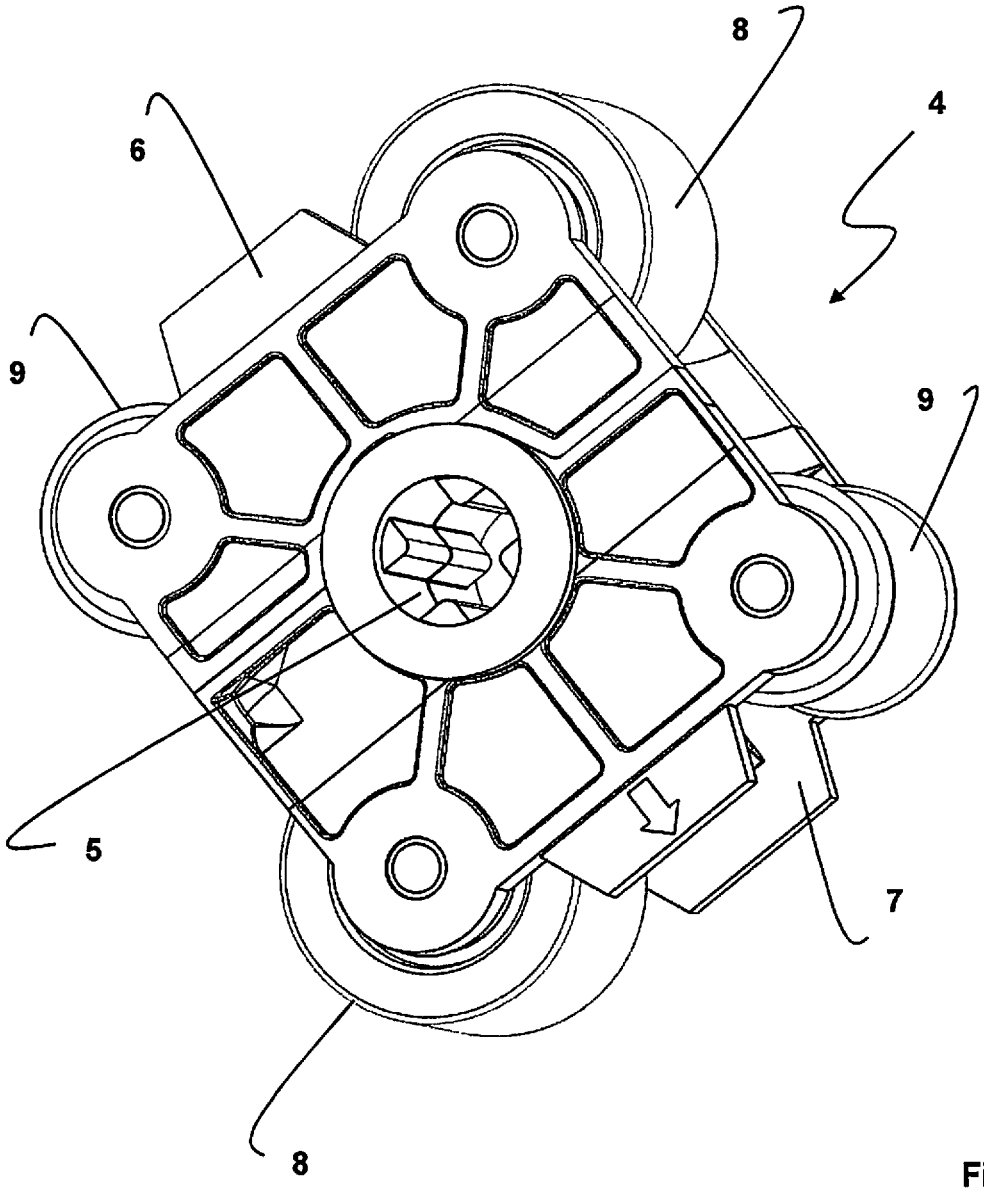
Figure 4:
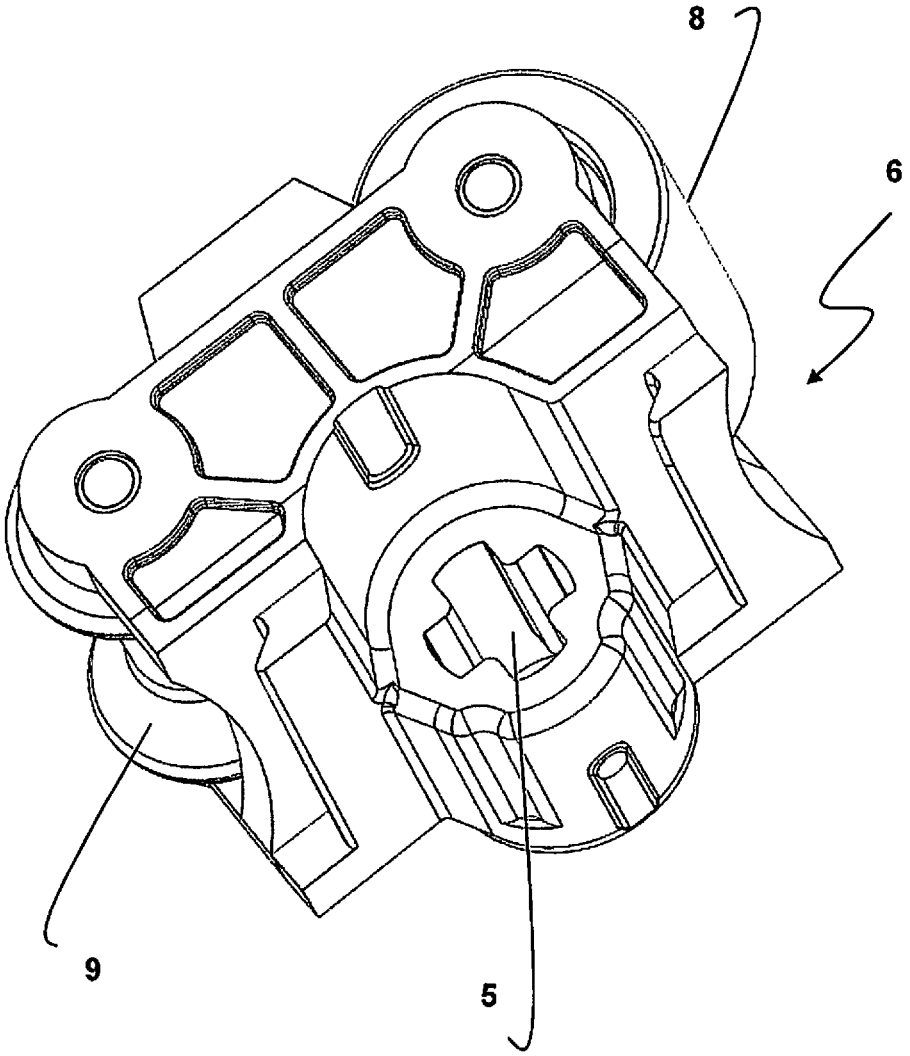
Figure 5:
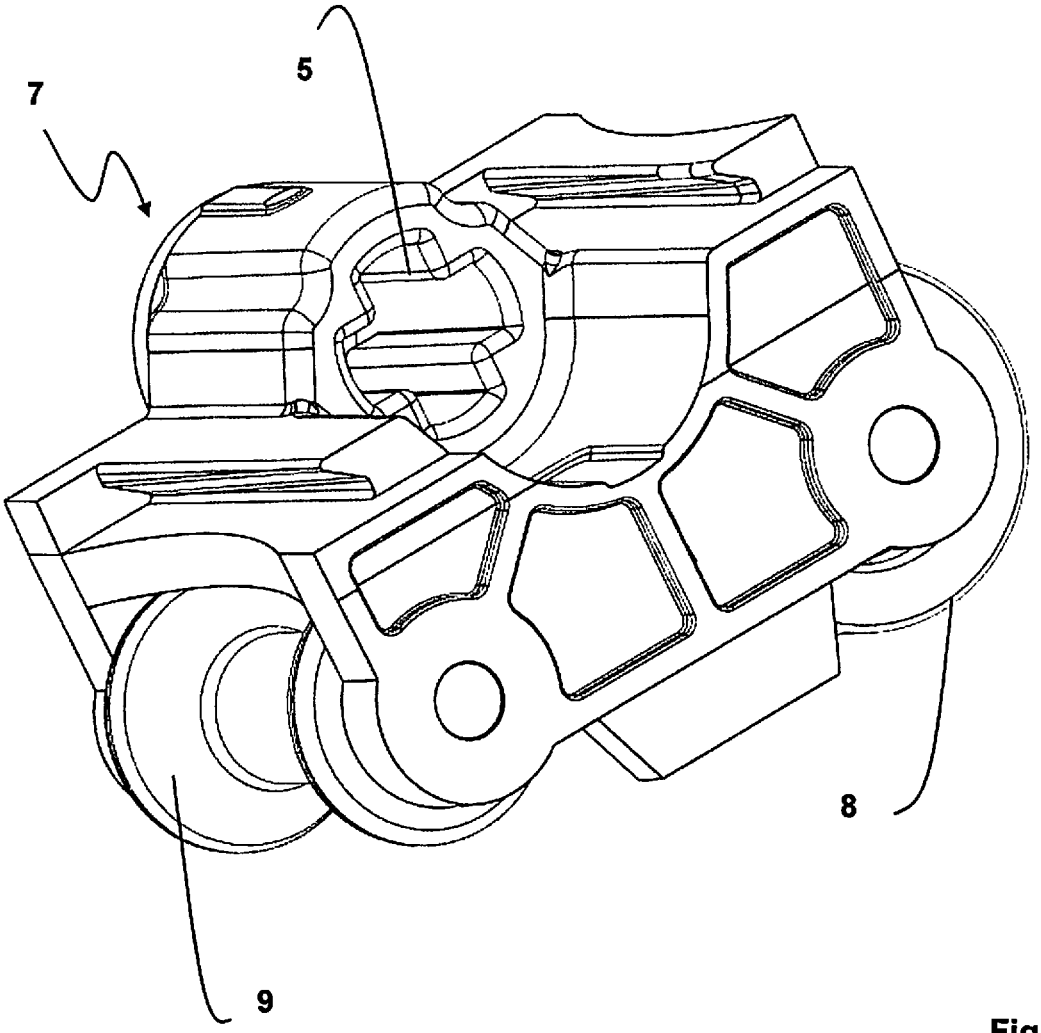
Figure 6:
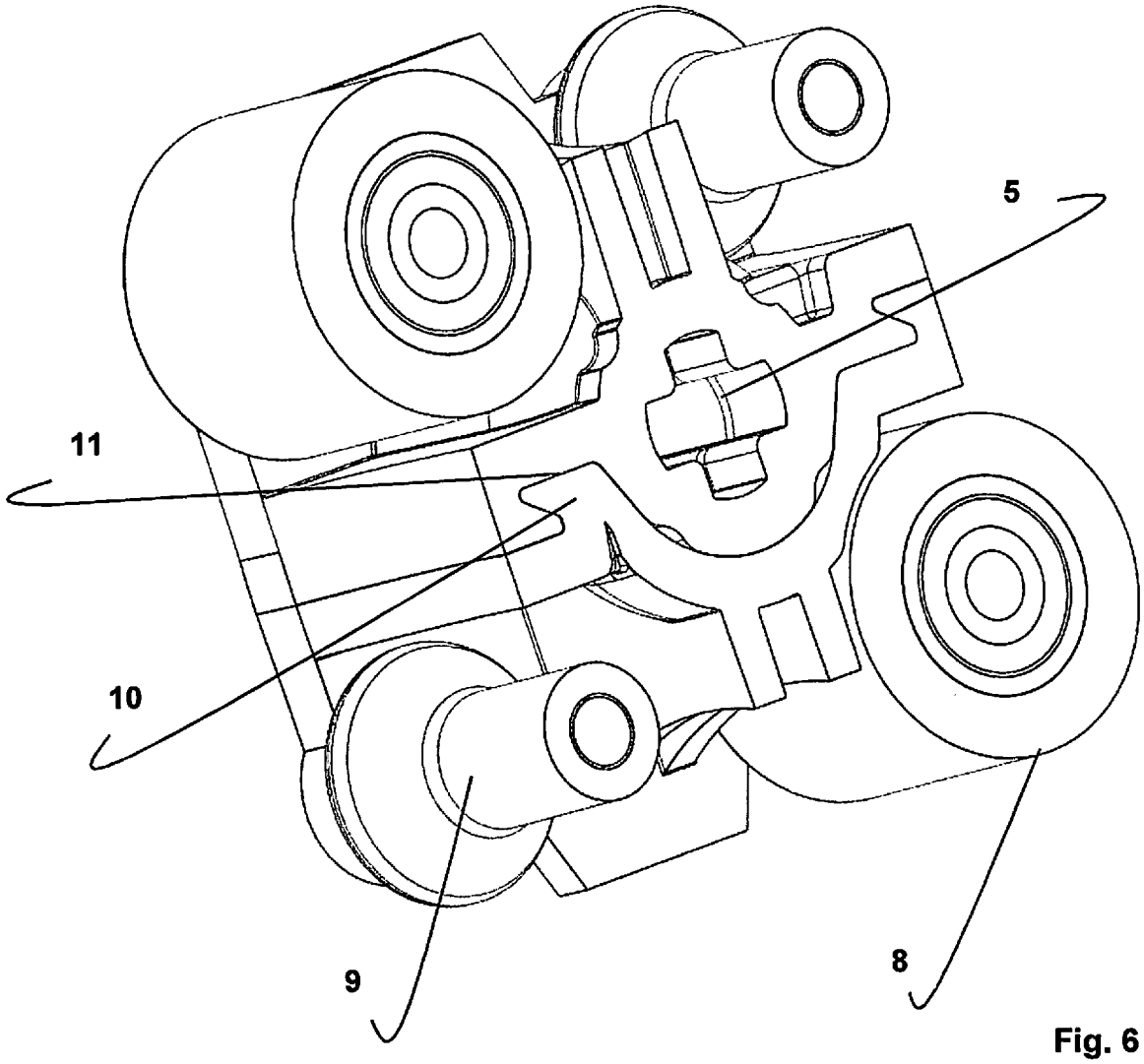

Further advantages, features and possible applications of the present invention will be clearly apparent from the description hereinafter of a preferred embodiment and the accompanying Figures in which:

FIG. 1*a* shows a plan view of an embodiment according to the invention of a peristaltic pump, FIG. 1*b* shows a plan view of the peristaltic pump of FIG. 1*a* with the housing cover opened, FIG. 2 shows a perspective view of the rotor with drive unit, FIG. 3 shows a perspective view of the displacement element, FIG. 4 shows a perspective view of the first part of the displacement element, FIG. 5 shows a perspective view of the second part of the displacement element, and FIG. 6 shows a perspective sectional view through the displacement element.

Figure 7A:
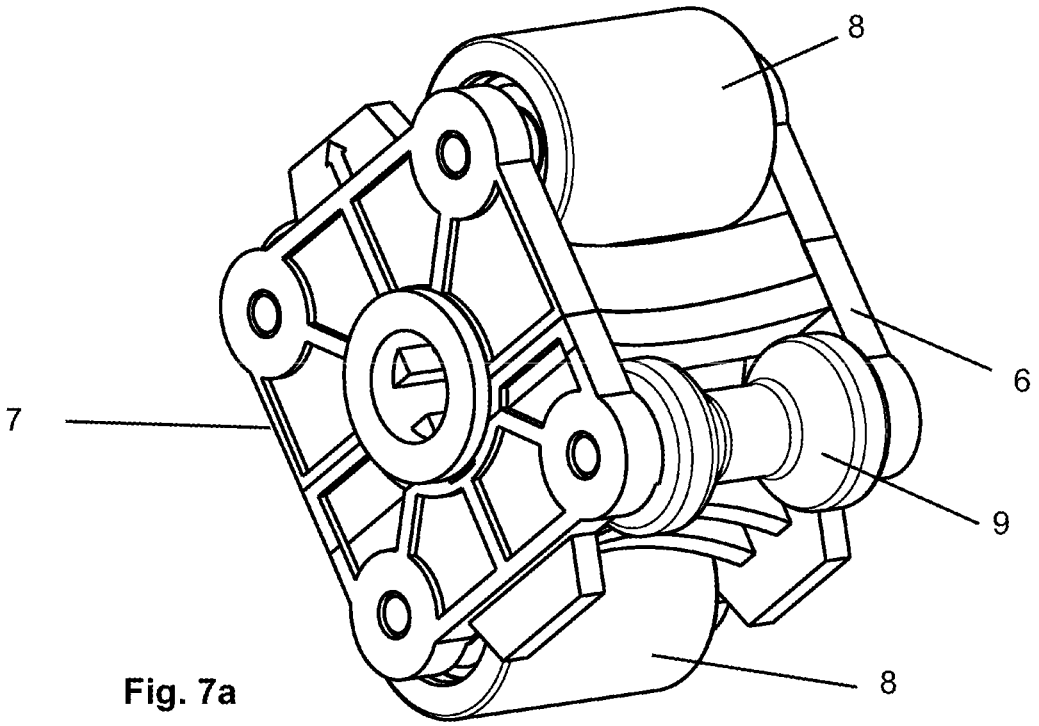

FIG. 7*a* is a perspective view of the displacement element shown in a working position.

Figure 7B:
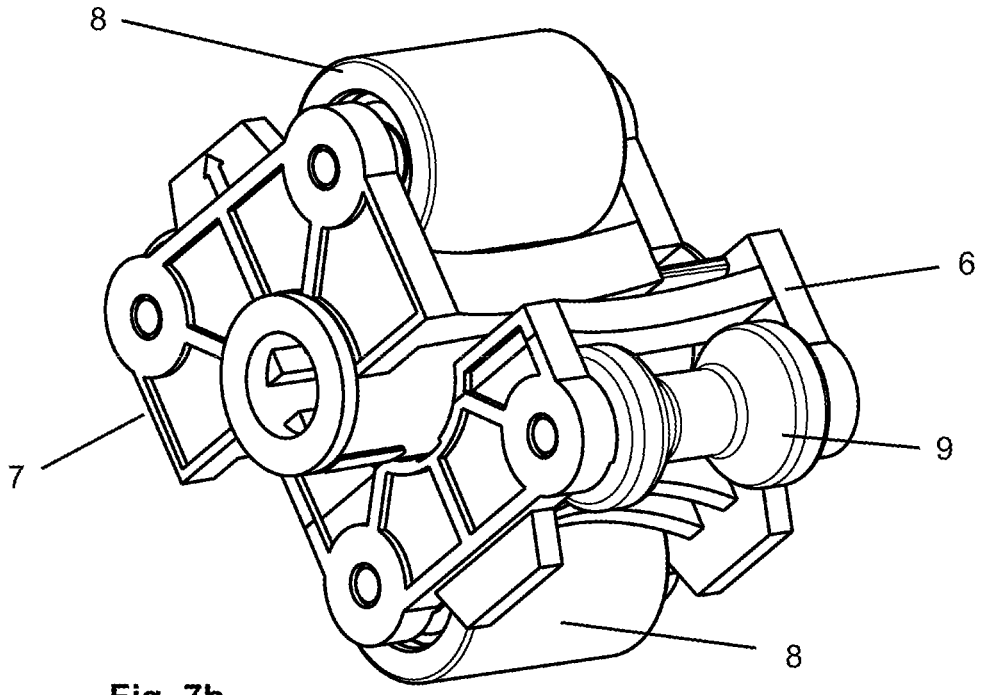

FIG. 7*b* is a perspective view of the displacement element of FIG. 7*a* shown in a change position.

FIG. 1*a* shows a plan view of an embodiment of the peristaltic pump 1 according to the invention. The peristaltic pump 1 has a casing 12 having a casing bottom (not shown) and a casing cover 13 as well as a casing wall 14 extending between the casing bottom and the casing cover 13. It is also possible to see a casing inlet 15 and a casing outlet 16.

FIG. 1*b* shows a plan view of the peristaltic pump of FIG. 1*a* with the casing cover 13 opened. The casing inlet 15 and the casing outlet 16 are connected together by way of a tube 17. It is also possible to see a displacement element 4 fixed to a rotor 2. The displacement element 4 has two displacement members 8. When the displacement element 4 is rotated by means of the rotor 2 about the rotor axis the displacement members 8 roll against the tube 17 and mechanically deform it so that fluid to be conveyed which is disposed in the tube 17 is urged within the tube 17 from the casing inlet 15 to the casing outlet 16. The peristaltic pump 1 does not need any valve. It is also self-blocking as in any position of the rotor 2 a displacement member 8 is directly connected to the tube 17 in such a way that it is elastically deformed in such a fashion that no fluid to be conveyed can flow through the deformed portion.

FIG. 2 shows a perspective view of the drive unit 3 with the rotor 2. The rotor 2 is of a non-circular cross-section and in the illustrated embodiment the cross-section is cross-shaped. A drive unit 3 is capable of rotating the rotor 2 about its longitudinal axis, the so-called rotor axis.

FIG. 3 shows a perspective view of the displacement element 4. The displacement element 4 comprises two parts, namely the first part 6 and the second part 7. Two displacement members 8 in the form of rollers are arranged on the displacement element. In addition there are two guide members 9 which are also in the form of rollers. The displacement members 8 are provided to deform the tube portion with which they come into contact in such a way that the flow through that tube portion is prevented. The guide members 9 also roll against the tube without however deforming it in such a way that a flow therethrough is still possible. The guide members 9 therefore do not serve a pump function but only serve to guide the tube. The displacement element 4 has a through opening 5, the internal contour of which is adapted to the external contour of the rotor 2. When the displacement element 4 is fitted on to the rotor 2 the rotor 2 and the displacement element 4 are positively connected together in such a way that the displacement element 4 follows the rotary movement of the rotor 2.

FIGS. 4 and 5 show a perspective view of the two parts 6 and 7 of the displacement element, wherein for illustration purposes the second part 7 shown in FIG. 5 has been rotated through 180°. The two parts 6 and 7 each have a respective displacement member 8 and a guide member 9. In addition both parts 6 and 7 have a through opening 5 adapted to the external contour of the rotor 2.

FIG. 6 shows a perspective sectional view through the displacement element 4. The through openings 5 in the two parts 6 and 7 are aligned so that the rotor 2 can be fitted through both through openings 5. It will be seen that one of the parts 6, 7 has a groove 11 of an undercut configuration, into which engages a corresponding rib in the form of a sliding block 10. That provides a positively locking connection.

FIG. 7*a* is a perspective view of the displacement element 4 shown in a closed or working position in which the operating planes of the first part 6 and the second part 7 are the same. FIG. 7*b* is a perspective view of the displacement dement 4 of FIG. 7*a* shown in an open or change position and in which the operating planes of the first part 6 and the second part 7 are spaced apart, but are parallel to each other.

To change the tube it is only necessary for the second part 7 of the displacement element 4 to be moved in the direction of the rotor axis relative to the first part 6 of the displacement element so that the operative plane formed by the associated displacement element 8 is displaced with respect to the operative plane of the displacement element 8 of the first part 6.

That is possible generally only when the associated displacement element 8 is not in engagement with the tube. Possibly therefore firstly the rotor 2 including the displacement element 4 has to be rotated until the displacement member 8 of the second part 7 of the displacement element 4 no longer comes into contact with the tube. Then the second part 7 of the displacement element 4 can be displaced parallel to the rotor axis relative to the first part 6.

In the illustrated embodiment it is even possible for the second part to be removed from the first part. As soon as the second part has been displaced relative to the first part or has even been removed the displacement element 4 can be further rotated until the displacement member 8 of the remaining part comes out of engagement with the tube. In that position no displacement member 8 is in contact with the tube so that the peristaltic pump is no longer self-blocking for that moment.

It will be noted however that it is now possible for the tube to be easily removed and replaced by a fresh tube. Assembly is then effected in the reverse sequence, that is to say after the tube has been fitted into the housing then firstly the displacement element 4 is again rotated through 180° so that the first part 6 or its displacement member 8 comes into engagement with the tube again. The second part 6 can then be pushed on to the rotor 2 again so that the sliding block 10 moves within the groove 11. As soon as the operative planes of the two displacement members 8 are again identical the peristaltic pump is again ready for operation. The housing cover is possibly to be closed.

LIST OF REFERENCES

1 peristaltic pump
2 rotor
3 drive unit
4 displacement element
5 through opening
6 first part of the displacement element
7 second part of the displacement element
8 displacement member
9 guide member
10 sliding block
11 undercut groove
12 casing
13 casing cover
14 casing wall
15 casing inlet
16 casing outlet
17 tube

The invention claimed is:

1. A peristaltic pump comprising a casing which has a casing bottom, a casing cover and a casing wall extending from the casing bottom to the casing cover, which form a pump chamber, and a casing inlet and a casing outlet which respectively provide a communication with the pump chamber, a tube which connects the casing inlet to the casing outlet and is arranged within the pump chamber, and a displacement element which has at least two displacement members and is fixed to a rotor which is rotatable about a rotor axis so that in the rotary movement of the rotor each displacement member of the at least two displacement members performs a movement in an operative plane, wherein the tube is arranged between the casing wall and the displacement element in such a way that due to rotation of the rotor the displacement members slide or roll on the tube so that the tube is squashed together and a medium to be conveyed which is in the tube is displaced in the direction of the casing outlet, characterised in that the displacement element is of a two-part structure comprising a first part which is fixed to the rotor and a second part which has a displacement member of the at least two displacement members, wherein the second part of the displacement element in at least one position relative to the rotor and the first part of the displacement element can be reciprocated between an operative position in which the operative planes of the at least two displacement members are identical and a change position in which the operative planes of the two displacement members are arranged parallel to each other, and wherein the second part of the displacement element is fixed to the rotor in both the operative position and the change position.

2. The peristaltic pump according to claim 1 characterised in that at least one part of the casing cover is removable and the second part of the displacement element in at least one position of the rotor is releasable from the first part of the displacement element.

3. The peristaltic pump according to claim 2 characterised in that each part of the displacement element has at least a displacement member or the at least two displacement members, wherein there are provided at least two support members, wherein at least one support member of the at least two support members is provided at each part of the displacement element, wherein by virtue of rotation of the rotor the support members of the at least two support members slide or roll on the tube, wherein the support members of the at least two support members are so arranged that they do not displace any conveyed medium in the tube.

4. The peristaltic pump according to claim 2 characterised in that the rotor is of a non-circular cross-section, wherein the first part of the displacement element and the second part of the displacement element have a through opening, an internal contour of which is of a configuration corresponding to an external contour of the rotor, so that when the first and/or the second part of the displacement element is pushed with its through opening over the rotor a positively locking connection is produced between the rotor and the first or second part of the displacement element.

5. The peristaltic pump according to claim 2 characterised in that the first part and the second part of the displacement element are connected together by way of a groove-sliding block connection, wherein a groove of the groove-sliding block connection extends parallel to the rotor axis, wherein the groove of the groove-sliding block connection is of an undercut configuration and a sliding block of the groove-sliding block connection is of a configuration corresponding to the groove of the groove-sliding block connection.

6. The peristaltic pump according to claim 2 characterised in that the displacement element and the tube are so arranged in the casing that by rotation of the rotor each displacement member of the at least two displacement members can be moved into a position in which the displacement member is not in contact with the tube.

7. The peristaltic pump according to claim 1 characterised in that each part of the displacement element has at least a displacement member of the at least two displacement members, wherein there are provided at least two support members, wherein at least one support member of the at least two support members is provided at each part of the displacement element, wherein by virtue of rotation of the rotor the support members of the at least two support members slide or roll on the tube, wherein the support members of the at least two support members are so arranged that they do not displace any conveyed medium in the tube.

8. The peristaltic pump according to claim 7 characterised in that the rotor is of a non-circular cross-section, wherein the first part of the displacement element and the second part of the displacement element have a through opening, an internal contour of which is of a configuration corresponding to an external contour of the rotor, so that when the first and/or the second part of the displacement element is pushed with its through opening over the rotor a positively locking connection is produced between the rotor and the first or second part of the displacement element.

9. The peristaltic pump according to claim 7 characterised in that the first part and the second part of the displacement element are connected together by way of a groove-sliding block connection, wherein a groove of the groove-sliding block connection extends parallel to the rotor axis, wherein the groove of the groove-sliding block connection is of an undercut configuration and a sliding block of the groove-sliding block connection is of a configuration corresponding to the groove of the groove-sliding block connection.

10. The peristaltic pump according to claim 7 characterised in that the displacement element and the tube are so arranged in the casing that by rotation of the rotor each displacement member of the at least two displacement members can be moved into a position in which the displacement member is not in contact with the tube.

11. The peristaltic pump according to claim 1 characterised in that the rotor is of a non-circular cross-section, wherein the first part of the displacement element and the second part of the displacement element have a through opening, an internal contour of which is of a configuration corresponding to an external contour of the rotor, so that when the first and/or the second part of the displacement element is pushed with its through opening over the rotor a positively locking connection is produced between the rotor and the first or second part of the displacement element.

12. The peristaltic pump according to claim 11 characterised in that the first part and the second part of the displacement element are connected together by way of a groove-sliding block connection, wherein a groove of the groove-sliding block connection extends parallel to the rotor axis, wherein the groove of the groove-sliding block connection is of an undercut configuration and a sliding block of the groove-sliding block connection is of a configuration corresponding to the groove of the groove-sliding block connection.

13. The peristaltic pump according to claim 1 characterised in that the first part and the second part of the displacement element are connected together by way of a groove-sliding block connection, wherein a groove of the groove-sliding block connection extends parallel to the rotor axis, wherein the groove of the groove-sliding block connection is of an undercut configuration and a sliding block of the groove-sliding block connection is of a configuration corresponding to the groove.

14. The peristaltic pump according to claim 1 characterised in that the displacement element and the tube are so arranged in the casing that by rotation of the rotor each displacement member of the at least two displacement members can be moved into a position in which the displacement member of the at least two displacement members is not in contact with the tube.

* * * * *